United States Patent [19]

Stuckey

[11] Patent Number: 4,545,268

[45] Date of Patent: Oct. 8, 1985

[54] COMPACT TORQUE CONVERTER TOOL

[76] Inventor: William C. Stuckey, 1503 Virginia St., E. Charleston, W. Va. 25311

[21] Appl. No.: 615,639

[22] Filed: May 31, 1984

[51] Int. Cl.[4] ..... B25B 17/00

[52] U.S. Cl. ..... 81/57.31

[58] Field of Search ..... 81/57.31, 57.11; 74/417, 425, 427, 423

[56] References Cited

U.S. PATENT DOCUMENTS

| | | | |
|---|---|---|---|
| 400,550 | 4/1889 | Darling | 74/425 |
| 2,777,346 | 1/1957 | Brame | 81/57.31 |
| 2,791,142 | 5/1957 | Lyon | 81/57.31 |
| 3,232,149 | 2/1966 | Duchesne | 81/57.31 |
| 4,296,654 | 10/1981 | Mercer | 81/57.31 |

*Primary Examiner*—James L. Jones, Jr.
*Attorney, Agent, or Firm*—Jim Zegeer

[57] ABSTRACT

A compact torque converter tool having high mechanical advantages comprised of an input bevel gear having an axis colinear with the direction of drive, meshed with a further bevel gear having an axis transverse to the direction of drive, the further bevel gear having a gear member meshed to drive a gear driving a worm or helical gear with an axis transverse to the direction of drive but spaced therefrom, and an output gear coaxial with the input and has gear member meshed with the worm gear. The worm gear may also be driven by an input spur gear having an axis colinear with the direction of drive, meshed with a further spur gear that is coaxial with a helical thread gear that is meshed with another helical gear that is coaxial with the helical thread worm gear. The helical thread (or worm) on the worm gear can be oriented so as to drive a concave faced gear wheel (or worm wheel) in a selected direction.

10 Claims, 10 Drawing Figures

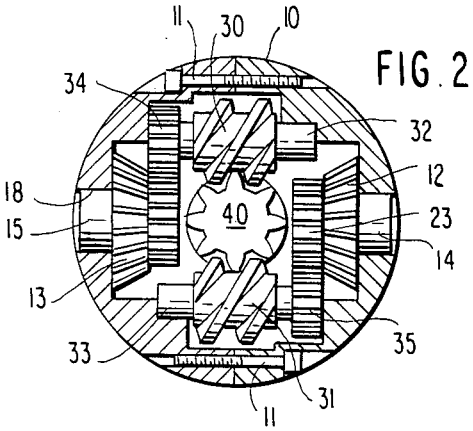
FIG. 2
FIG. 3
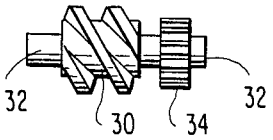
FIG. 1
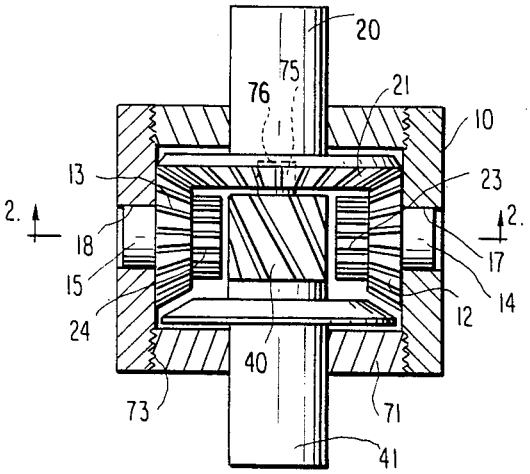
FIG. 4
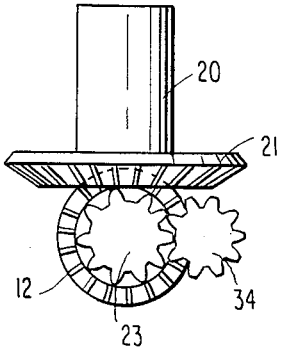
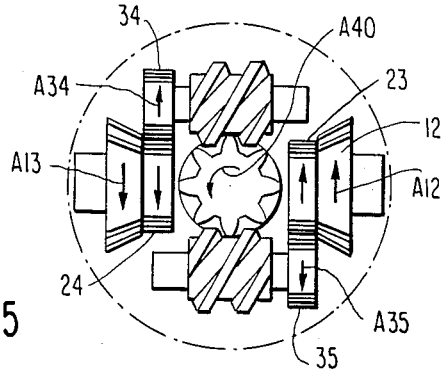
FIG. 5

FIG. 6
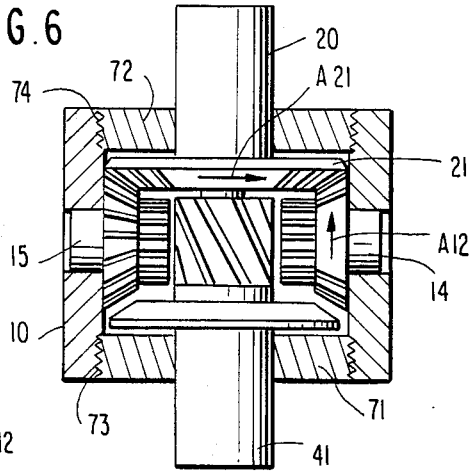
FIG. 7
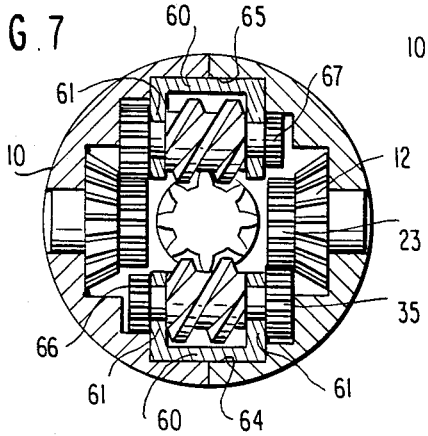
FIG. 8
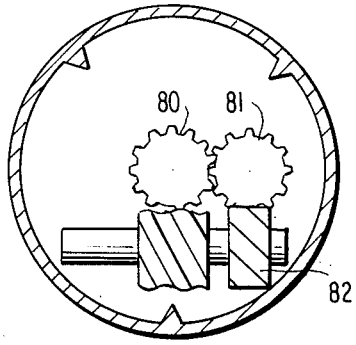
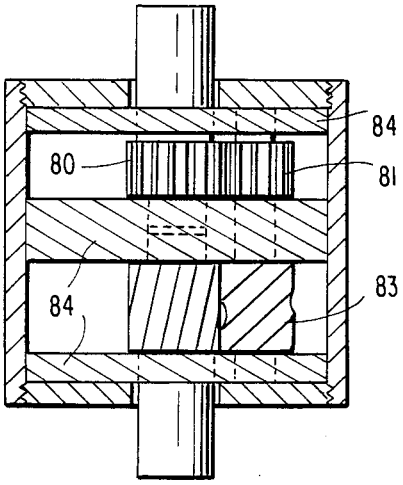
FIG. 10
FIG. 9
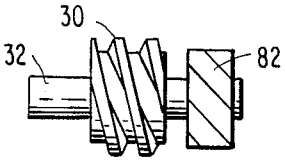

COMPACT TORQUE CONVERTER TOOL

BACKGROUND AND BRIEF DESCRIPTION OF THE INVENTION

The present invention relates to compact torque converter tools which are very compact and which provides a high mechanical advantage and while designed particularly for use with lug wrenches, is not limited thereto and is easily adaptable for use in numerous environments.

In the prior art, numerous efforts have been directed to providing torque converters, speed wrenches and the like utilizing various forms of gearing. In the case of lug wrenches for removing hub nuts or lug nuts from the wheels of automobiles, these required that the housing in some way be anchored to the wheel or ground to prevent their rotation during operation of the device. The present invention provides an internal braking through the use of a worm or helical gear having a high reduction ratio and having an axis transverse to the drive axis and spaced therefrom which is drivingly coupled to a bevel gear pair (a crown bevel gear and a pinion bevel gear) with one element of the bevel gear pair being rotatably mounted in the annular housing. A first coupling gear on the axis of and driven with the beveled pinion gear of the bevel gear pair is drivingly coupled to a second coupling gear which is integral with a worm-helical gear journaled for rotation in the annular housing about an axis transverse to the axis of the annular housing and spaced from the axis thereof. This second coupling gear couples the rotary movements of the beveled pinion gear means to an output torque member. The output torque member is integrally formed on the shaft of a gear which is meshed with the worm gear. The use of the worm gear is this preferred embodiment substantially prevents rotation of the housing and constrains the movement of the annular housing without requiring that the housing be restrained by some physical obstruction or by holding same.

As noted earlier, torquing or speed lug wrenches are known in the art, some of which are particularly adapted for lug wrenches such as, for example, Osmond U.S. Pat. No. 3,992,964 and Michaud U.S. Pat. No. 4,274,310 both use planetary gearing systems, some of which are tandem planetary gearings with one or more annular housing. Similarly, the gear wrench of Wagner Pat. No. Re29,993 discloses tandem planetary gear units and require that the housing have a support for holding the housing stationary relative to the shafts. Sauter U.S. Pat. No. 3,331,269 and Duchesne U.S. Pat. No. 3,208,317 relate to tools in which beveled gears are utilized and are contained in a housing that serves as the handle for supplying input torque. In Chriswell U.S. Pat. No. 2,721,591, the disclosure relates to a geared screw driver using a conventional planetary gear wherein the ring gear is formed as part of the housing. In McDonald U.S. Pat. No. 3,861,244, the torque wrench utilizes a casing having a reaction bar and a power input coming from an eccentrically arranged drive arm. The geared screw driver of Schefield Pat. No. 3,823,755 has the planetary gearing arrangement contained within the handle of the screw driver. The ratchet attachment of Taub U.S. Pat. No. 4,279,314 incorporates an energy storing attachment—e.g. a spring which is used for loosening. In Schnepel et al U.S. Pat. No. 2,510,483, a speed and power geared hand wrench and an operating handle is formed as a part of or an attachment to the housing containing the gearing mechanism and in Marsten, Jr., et al U.S. Pat. No. 2,641,136, a separate handle is provided for controlling the movement of the gear mechanism.

The present invention is an improvement over the art in that it can be manufactured more compactly and, there is no need for appurtenances for preventing or locking rotatation of the housing. The function is performed by the internal gear arrangement including the worm gear and worm wheel with high reduction ratios and combination of components.

BRIEF DESCRIPTION OF THE DRAWINGS

The above and other objects, advantages and features of the invention will become more apparent when considered in conjunction with the following specification and accompanying drawings wherein:

FIG. 1 is a side sectional view of a compact torque converter incorporating the invention, FIG. 2 is a cross-sectional view taken on lines 2—2 of FIG. 1, FIG. 3 is a side view of a worm gear and its spur gear associated therewith (second coupling gear), FIG. 4 is a diagrammatic view illustrating the spur gear on the worm gear as it is meshed with the first coupling gear on the beveled pinion gear, FIG. 5 is a reproduction of FIG. 2 with arrows indicating direction of movement of the component parts, FIG. 6 is FIG. 1 with similar directional arrows for indicating the movement, FIG. 7 is a modification of the invention, FIG. 8 is a cross-sectional view taken on lines 2—2 of FIG. 10, FIG. 9 is a side view of a worm gear and its helical gear, and FIG. 10 is a side-elevational view of a compact torque converter using the spur gear drive.

DETAILED DESCRIPTION OF THE INVENTION

Referring now to FIG. 1, an annular housing 10, which may be formed in two parts and held assembled by screws 11, has a pair of bevel pinion gears 12 and 13 on stub axels 14 and 15, respectively, which are journaled in bearing means 17 and 18 in annular housing 10. An input torque member 20, which may be of any design configuration such as square or hexagonal (or have a hole for a turning bar) for receiving an input torque has a crown bevel gear 21 integrally formed on the ends thereof which is contained within housing 10. Crown bevel gear 21 is meshed with pinion bevel gear 12 to form a bevel gear pair. Bevel pinion gears 12 and 13 have integrally formed therewith spur gears 23 and 24 which serves as first coupling gears on the axis of and driven with the bevel pinion gear means 12 and 13. Thus, the bevel gear means 12 and 13 are journaled for rotation about an axis transverse to the axis of the annular housing with bevel gears 12 and 13 being coaxial with each other and normal to the axis of input torque member 20. A pair of helical-worm gear members 30 and 31 are journaled for rotation in annular housing member 10 (and as shown in FIG. 7) may be carried in small channel members for ease of assembly. Shafts 32 and 33 of worm gears 30 and 31, respectively, carry spur gears 34 and 35, respectively, which serve as second coupling gears integral with the worm gear and are drivingly engaged with first coupling spur gears 23 and 24, respectively. Worm gears 30 and 31 are in effect lead screws and the direction of the lands or teeth of each worm can be angled slanted to the right or to the left depending on the desired direction of drive output (with the degree of angulation or slanting being a factor in the reduction ratio). In some automobilies, the hub nuts have threads which are reversed to conventional hub nut thread directions and hence must be rotated in an opposite direction then conventional for removal. Accordingly, it may be desirable in some cases for the direction of output to be reversed which simply means that a reversal in the direction of the worm thread pitch on worm screws 30 and 31. The worm threads may be single or multistart helical threads. Worm screws 30 and 31 are commonly meshed or engaged in sliding contact with a corresponding concave faced or complementary worm gear wheel 40 on output torque member 41.

With reference to FIGS. 5 and 6, it will be noted that when the input torque member 20 is turned counter-clockwise—e.g. in an direction normally to remove a nut, the crown bevel gear 21 rotates counter-clockwise which is indicated by the arrow A21. This will rotate bevel pinion gear 12 and its integral spur gear 23 in a direction indicated by the arrows A12. Spur gear 35 meshed with spur gear 23 is rotated in an opposite direction as indicated by the arrows A35. When spur gear 35 is rotated in the direction indicated by the arrows A35, the worm flights F31 on worm gear 31 and worm flights F32 on worm gear 32 rotate in a direction which will cause the clockwise rotation of the meshed worm gear 40 as indicated by the arrow A40.

Seal discs 71 and 72 are threadably engaged with internal threads 73 and 74 on annular housing 10, and could also be cup shaped members engaging external threads at ends 76 of the annular housing. The input and output shafts pass freely through bores or openings in discs 71 and 72.

As shown in FIG. 1, a short stub axial 75 projects on output torque member 41 into a bearing surface 76 in input torque member 20.

As noted earlier, if it is desired to reverse the direction of the output drive torque from the input drive torque direction, all that is necessary is a reversal of the direction or angulation of the worm flights F31 and F32 on the worm screws F31 and F32.

Thus, the invention achieves a compact torque converter which is easy to use and does not require a braking or locking elements on the housing. It can be used widely for screw drivers, ratchet wrenches, as an attachment to drills and the like and produces a high torque output. The use of pairs of high reduction worm gears in their associated spur bevel and bevel pair gears provides a balanced loading on the component parts.

Referring to FIG. 7, (which is similar in most respects to FIG. 5) each worm gear is mounted in the housing 10 by means of a U-shaped bearing bracket 60 which has a pair of legs 61 which rotatably support the worm gears 30, 31 and their associated spur gears 34, 35 in annular housing 10. The recess 64, 65 in the annular housing snuggly receives the U-shaped member. Bearing gears 66 and 67 may be rotatably mounted on the ends of the stub axles 32, 33 but are not essential in any way to the operation.

FIG. 8 discloses the use of a pair of spur gears 80 and 81 as the input. Spur gear 80 is attached or foundered with input torque drive member 20 and is thus the input drive gear which is meshed with spur gear 81. Spur gear 81 is in turn coaxial with helical gear 83 which, in turn, is meshed with helical gear 82. Helical gear 82 is coaxial with helical worm gear 30. Elements 84 are washers and, as shown in FIG. 10, provide bearings for helical gears 80, 81 input spur gear 80 and output torque member which is meshed and drivingly engaged with the worm gear.

It is believed that the foregoing description and accompanying drawings clearly disclose the preferred embodiments of the invention but it is to be understood that these disclosures and embodiments are merely illustrative and that further changes and modifications to the invention may be made as are fairly within the scope and spirit of the claims appended hereto.

What is claimed is:

1. A compact torque converter for tools and the like comprising, in combination,
   - an annular housing,
   - an input torque member,
   - a bevel crown gear on said input torque member and coaxial with said annular housing,
   - bevel pinion gear means journeled for rotation in said housing and having an axis transverse to the axis of said annular housing,
   - a first coupling gear on the axis of and driven with said beveled pinion gear means,
   - a worm-helical gear journaled for rotation in said annular housing about an axis transverse to the axis of said annular housing and spaced from the axis thereof,
   - a second coupling gear integral with said worm gear and drivingly engaged with said first coupling gear for coupling rotary movements of said bevel pinion gear means to said worm gear,
   - an output torque member, and
   - means on said output torque member meshed with and drivingly engaged with said worm gear.

2. The compact torque converter tool as defined in claim 1 wherein said worm-helical gear has an hour glass shape.

3. The compact torque converter tool as defined in claim 1 wherein said worm-helical gear has drive teeth which are angled to provide a selected direction of output torque member rotation.

4. The compact torque converter as defined in claim 1 having a diameter under about $2\frac{1}{4}$ inch and an axial length of under about 3 inches.

5. The compact torque converter tool as defined in claim 1 wherein said annular housing is in at least two parts and include means for securing said two parts in assembly.

6. A compact torque converter tool comprising,
   - a housing having a drive axis,
   - an input torque bevel gear, rotatably mounted in said housing coaxial with said drive axis,
   - a pair of bevel pinion gears rotatably mounted in said housing on an axis transverse to said drive axis and meshed with said input torque bevel gear,
   - a first pair of spur gears formed integrally with said bevel pinion gears and coaxially therewith,
   - a pair of hour glass shaped helical worm gears rotatably mounted in said housing on an axis transverse to said drive axis and laterally spaced therefrom,
   - a second pair of spur gears formed integrally with said hour glass shaped helical worm gears and drivingly meshed with said first pair of spur gears,
   - a worm wheel commonly engaged with said pair of hour glass shaped worm gears, and an output torque member integrally formed with said worm wheel.

7. A compact torque converter for tools and the like comprising, in combination, a housing having a drive axis, an input torque member journaled for rotation in said housing, first input gear means integrally formed on said input torque member and coaxial with said torque member, second input gear means journaled for rotation in said housing and drivingly meshed with said first input gear means, a first coupling gear on the axis of and driven with said second input gear means, a worm-helical gear journaled for rotation in said annular housing about an axis transverse to the axis of said input torque member and spaced from the axis thereof, a second coupling gear integral with said worm-helical gear and drivingly engaged with said first coupling gear for coupling rotary movements of said first input gear means to said worm gear, an output torque member, and means on said output torque member meshed with and drivingly engaged with said worm gear.

8. The compact torque converter tool as defined in claim 7 wherein said worm-helical gear has drive teeth which are angled to provide a selected direction of rotation of said output torque member.

9. The compact torque converter tool as defined in claim 7 wherein said first and said second coupling gears are meshed helical gears.

10. The compact torque converter tool as defined in claim 7 wherein said first and second input gears are spur gears.

* * * * *